US010337769B2

(12) United States Patent
Oka et al.

(10) Patent No.: US 10,337,769 B2
(45) Date of Patent: Jul. 2, 2019

(54) AIR CONDITIONER

(71) Applicant: FUJITSU GENERAL LIMITED, Kanagawa (JP)

(72) Inventors: Yasuhiro Oka, Kanagawa (JP); Satoshi Tomioka, Kanagawa (JP); Makoto Shimotani, Kanagawa (JP); Takahiro Matsunaga, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 277 days.

(21) Appl. No.: 15/277,705

(22) Filed: Sep. 27, 2016

(65) Prior Publication Data

US 2017/0198943 A1 Jul. 13, 2017

(30) Foreign Application Priority Data

Jan. 8, 2016 (JP) ..... 2016-002698

(51) Int. Cl.
*F25B 13/00* (2006.01)
*F25B 49/02* (2006.01)

(52) U.S. Cl.
CPC ..... *F25B 13/00* (2013.01); *F25B 49/02* (2013.01); *F25B 2313/0233* (2013.01);
(Continued)

(58) Field of Classification Search
CPC .... F25B 2600/2513; F25B 2313/02334; F25B 2700/21163; F25B 2600/19; F25B 2600/2503
See application file for complete search history.

(56) References Cited

U.S. PATENT DOCUMENTS 8,505,321 B2 * 8/2013 Kawano ..... F25B 13/00 62/204
2009/0013700 A1 * 1/2009 Unezaki ..... F25B 9/008 62/77

(Continued)

FOREIGN PATENT DOCUMENTS

EP 2144018 A1 1/2010
EP 2261578 A1 12/2010

(Continued)

OTHER PUBLICATIONS

English Translation of JPH0833224.*

(Continued)

*Primary Examiner* — Christopher R Zerphey
*Assistant Examiner* — Schyler S Sanks
(74) *Attorney, Agent, or Firm* — Paratus Law Group, PLLC

(57) ABSTRACT

When a refrigerant amount balance control is executed, in indoor units where the refrigerant supercooling degree is lower than an average refrigerant supercooling degree, the refrigerant pressure on a downstream side of indoor expansion valves decreases since the degrees of opening of the valves are decreased. On the other hand, in an indoor unit where the refrigerant supercooling degree is higher than the average refrigerant supercooling degree, although the degrees of opening of the valves are made high, the refrigerant pressure on the downstream side of the valves decreases and this decreases the refrigerant pressure on the downstream side of the indoor expansion valve, so that the difference in pressure between on the upstream side and on the downstream side of the indoor expansion valve increases and the liquid refrigerant staying at an indoor heat exchanger of the indoor unit consequently flows out into a liquid pipe.

7 Claims, 5 Drawing Sheets

(52) U.S. Cl.
CPC ..... *F25B 2313/0292* (2013.01); *F25B 2313/02334* (2013.01); *F25B 2600/19* (2013.01); *F25B 2600/2513* (2013.01); *F25B 2700/1931* (2013.01); *F25B 2700/1933* (2013.01); *F25B 2700/21151* (2013.01); *F25B 2700/21152* (2013.01); *F25B 2700/21163* (2013.01); *F25B 2700/21175* (2013.01)

(56) References Cited

U.S. PATENT DOCUMENTS

| | | | | |
|---|---|---|---|---|
| 2010/0024454 | A1 | 2/2010 | Kawano et al. | |
| 2014/0026603 | A1* | 1/2014 | Toya ..... | F24F 1/0003 62/129 |

FOREIGN PATENT DOCUMENTS

| | | | | |
|---|---|---|---|---|
| EP | 2693130 | A2 | | 2/2014 |
| JP | S61-195255 | A | | 8/1986 |
| JP | 04028970 | | | 1/1992 |
| JP | H06-159843 | A | | 6/1994 |
| JP | H0833224 | | * | 3/1996 |
| JP | 2008-185292 | A | | 8/2008 |
| JP | 2011-158118 | A | | 8/2011 |
| JP | 2015-117854 | A | | 6/2015 |

OTHER PUBLICATIONS

May 10, 2017, European Search Report for related EP application No. 16190673.0.

Jan. 29, 2019, Japanese Office Action issued for related JP Application No. 2016-002698.

* cited by examiner

AIR CONDITIONER

CROSS-REFERENCE TO RELATED APPLICATION

The present application claims the benefit of priority of Japanese Patent Application No. 2016-002698, filed on Jan. 8, 2016, which is incorporated herein by reference.

TECHNICAL FIELD

The present invention relates to an air conditioner where a plurality of indoor units are connected to at least one outdoor unit by refrigerant pipes.

BACKGROUND ART

Air conditioners are known where a plurality of indoor units are connected to at least one outdoor unit by a liquid pipe and a gas pipe. Among such air conditioners, an air conditioner has been proposed where sufficient air conditioning ability can be displayed at each indoor unit by controlling a refrigerant circuit in consideration of the difference in height between the installation place of the outdoor unit and the installation places of the indoor units and the difference in height between the indoor units.

For example, in an air conditioner described in JP-A-4-28970, an outdoor unit provided with a compressor, a four-way valve, an outdoor heat exchanger, an outdoor fan and an outdoor expansion valve is installed on the ground, whereas two indoor units each provided with an indoor heat exchanger, an indoor expansion valve and an indoor fan are installed with a difference in height therebetween in higher places than the outdoor unit (JP-A-4-28970, one indoor unit is installed on the first floor of a building and the other indoor unit, on the fourth floor in higher places than the outdoor unit), and the two indoor units and the outdoor unit are connected by refrigerant pipes to form a refrigerant circuit.

When cooling operation is performed by this air conditioner, since the liquid refrigerant condensed at the outdoor unit and having flown from the outdoor unit into the liquid pipe flows to each indoor unit against gravity, the pressure of the liquid refrigerant on the upstream side (the outdoor unit side) of the indoor expansion valve of the indoor unit installed in the higher position is lower than the pressure of the liquid refrigerant on the upstream side of the indoor expansion valve of the indoor unit installed in the lower position.

For this reason, the difference between the refrigerant pressure on the upstream side of the indoor expansion valve of the indoor unit installed in the higher position and the refrigerant pressure on the downstream side thereof (the indoor heat exchanger side) is small compared with the difference between the refrigerant pressure on the upstream side of the indoor expansion valve of the indoor unit installed in the lower position and the refrigerant pressure on the downstream side thereof. Since the amount of refrigerant flowing through the indoor expansion valve decreases as the difference in pressure between on the upstream side and on the downstream side of the indoor expansion valve decreases, a large amount of refrigerant flows in the indoor unit installed in the lower position, whereas the amount of refrigerant flowing in the indoor unit installed in the higher position decreases and there is a possibility that sufficient cooling ability is not obtained.

Therefore, in the air conditioner disclosed in JP-A-4-28970, the degree of opening of the indoor expansion valve of the indoor unit installed in the lower position is made smaller by a predetermined degree than the degree of opening of the indoor expansion valve of the indoor unit installed in the higher position, whereby the amount of flow of the refrigerant in the indoor unit installed in the lower position is decreased and the amount of flow of the refrigerant in the indoor unit installed in the higher position is increased. Thereby, even in the air conditioner where the outdoor unit is installed on the ground and the two indoor units are installed with a difference in height therebetween in higher places than the outdoor unit, sufficient cooling ability can be displayed by the indoor unit installed in the higher position. When heating operation is performed by an air conditioner where indoor units are installed with a difference in height therebetween and an outdoor unit is installed in a higher position than the indoor units unlike the air conditioner of JP-A-4-28970, a problem described below arises.

In heating operation, while the gas refrigerant discharged from the compressor flows into the indoor heat exchanger of each indoor unit to be condensed, since the liquid refrigerant condensed at the indoor heat exchanger and having flown into the liquid pipe flows against gravity toward the outdoor unit installed in the higher position, the lower the position in which an indoor unit is installed is, the more difficult it is for the liquid refrigerant having flown from the indoor unit into the liquid pipe to flow toward the outdoor unit. Thereby, the pressure of the liquid refrigerant on the downstream side (the outdoor unit side) of the indoor expansion valve of the indoor unit installed in the lower position becomes higher than the pressure of the liquid refrigerant on the downstream side of the indoor expansion valve of the indoor unit installed in the higher position. Consequently, the difference between the refrigerant pressure on the upstream side (the indoor heat exchanger side) of the indoor expansion valve of the indoor unit installed in the lower position and the refrigerant pressure on the downstream side thereof becomes small compared with the difference between the refrigerant pressure on the upstream side of the indoor expansion valve of the indoor unit installed in the higher position and the refrigerant pressure on the downstream side thereof.

Since the amount of refrigerant flowing through the indoor expansion valve decreases as the difference between the refrigerant pressure on the upstream side of the indoor expansion valve and the refrigerant pressure on the downstream side thereof decreases, a large amount of refrigerant flows in the indoor unit installed in the higher position, whereas the amount of refrigerant flowing in the indoor unit installed in the lower position decreases and there is a possibility that sufficient heating ability is not obtained in the indoor unit. Therefore, it is considered to perform control based on a principle similar to that of the air conditioner of Patent Document 1 so that the degree of opening of the indoor expansion vale of the indoor unit installed in the lower position is always higher than the degree of opening of the indoor expansion valve of the indoor unit installed in the higher position. Thereby, the amount of refrigerant flowing in the indoor unit installed in the lower position becomes large compared with the amount of refrigerant flowing in the indoor unit installed in the higher position, so that the heating ability at the indoor unit installed in the lower position can be improved.

Since it becomes more difficult for the liquid refrigerant having flown from the indoor unit installed in the lower position to flow in the liquid pipe toward the outdoor unit as the difference in height between the indoor unit installed in the lower position and the indoor unit installed in the higher position increases, the difference in pressure between the liquid refrigerants on the downstream side of the indoor expansion valves of these increases, and the difference between the refrigerant pressure on the upstream side of the indoor expansion vale of the indoor unit installed in the lower position and the refrigerant pressure on the downstream side thereof decreases. For this reason, it is necessary that the degree of opening of the indoor expansion valve of the indoor unit installed in the lower position be a degree of opening corresponding to the difference in height between the indoor unit installed in the lower position and the indoor unit installed in the higher position. That is, it is necessary that the degree of opening of the indoor expansion valve of the indoor unit installed in the lower position be increased as the difference in height between the indoor unit installed in the lower position and the indoor unit installed in the higher position increases.

However, the difference in height between the indoor unit installed in the lower position and the indoor unit installed in the higher position is large, and the liquid refrigerant having flown from the indoor unit installed in the lower position into the liquid pipe does not flow toward the outdoor unit; that is, when the liquid refrigerant stays below the liquid pipe, even if the degree of opening of the indoor expansion valve of the indoor unit installed in the lower position is made full opening, no refrigerant flows in the indoor unit and no heating ability is displayed (heating cannot be performed).

SUMMARY OF THE INVENTION

The present invention solves the above-mentioned problem, and an object thereof is to provide an air conditioner capable of displaying sufficient heating ability at each indoor unit at the time of heating operation even when the outdoor unit is installed in a higher position than a plurality of indoor units.

To solve the above-mentioned problem, an air conditioner of the present invention is provided with: an outdoor unit having a compressor and discharge pressure detector configured to detect a discharge pressure which is a pressure of a refrigerant discharged from the compressor, and a plurality of indoor units each having an indoor heat exchanger, an indoor expansion valve and liquid side temperature detector configured to detect a heat exchange exit temperature which is a temperature of the refrigerant flowing out from the indoor heat exchanger when the indoor heat exchanger is functioning as a condenser, and the outdoor unit is installed above the plurality of indoor units and there is a difference in height between installation places of the plurality of indoor units. And controller is provided for executing a refrigerant amount balance control to adjust degrees of opening of the indoor expansion valves so that refrigerant supercooling degrees of the indoor units become an average refrigerant supercooling degree obtained by using a maximum value and a minimum value of the refrigerant supercooling degrees or that the heat exchange exit temperatures of the indoor units become an average heat exchange exit temperature obtained by using a maximum value and a minimum value of the heat exchange exit temperatures when the air conditioner performs heating operation.

Moreover, the controller determines whether there is an indoor unit where heating ability is not displayed among the plurality of indoor units or not, and executes the refrigerant amount balance control when there is an indoor unit where heating ability is not displayed.

According to the air conditioner having such features, even when the outdoor unit is installed in a position higher than a plurality of indoor units, sufficient heating ability can be displayed in each indoor unit at the time of heating operation.

DETAILED DESCRIPTION

Hereinafter, embodiments of the present invention will be described in detail based on the attached drawings. The embodiments will be described by using as an example an air conditioner where to one outdoor unit installed on the roof of a building, three indoor units installed on the floors of the building, respectively, are connected in parallel and cooling operation or heating operation can be simultaneously performed by all the indoor units. The present invention is not limited to the following embodiments and may be variously modified without departing from the gist of the present invention.

First Embodiment

Figure 1A:
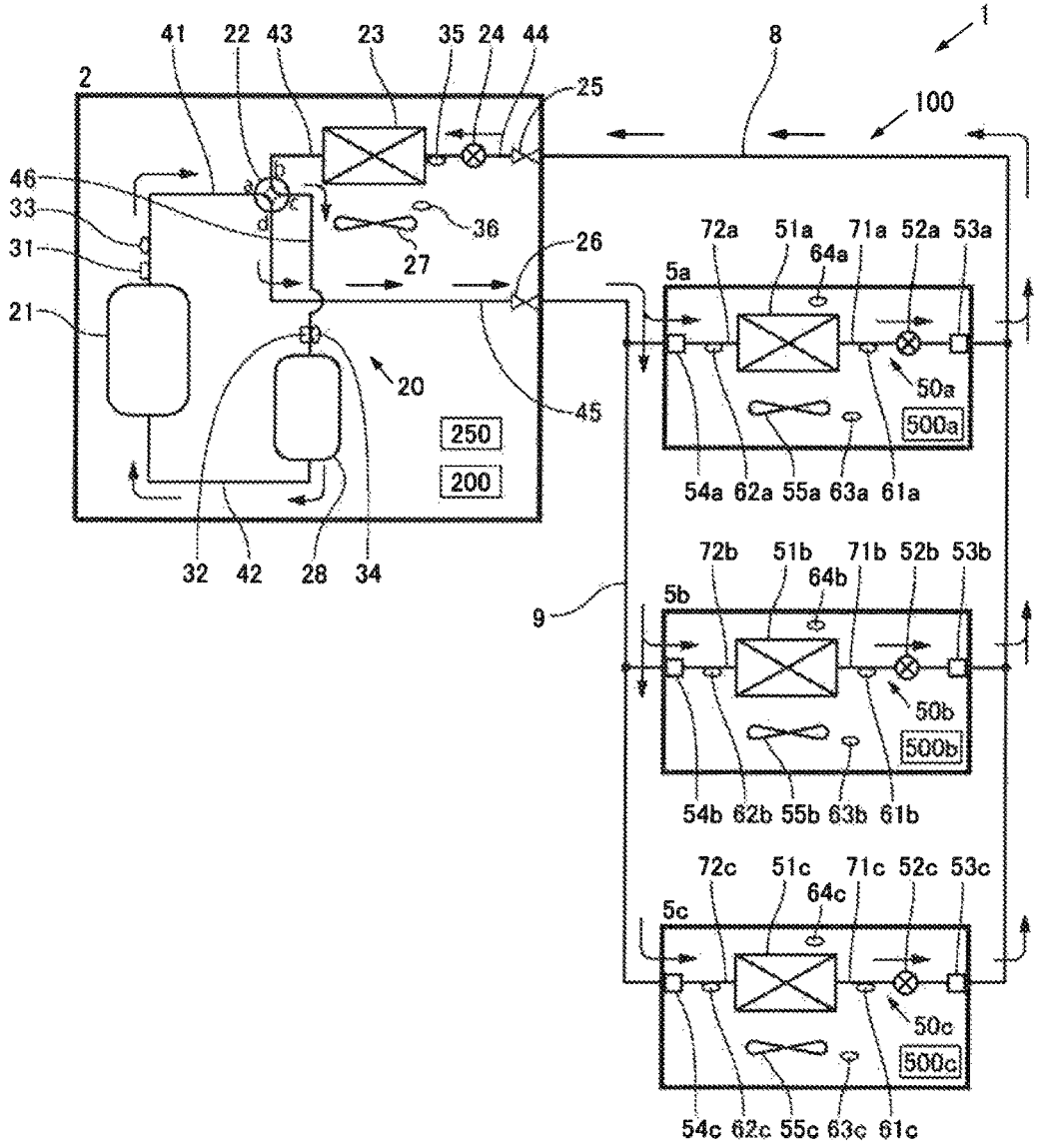
FIG. 1A is a circuit diagram of a refrigerant circuit of an air conditioner in an embodiment of the present invention.
Figure 2:
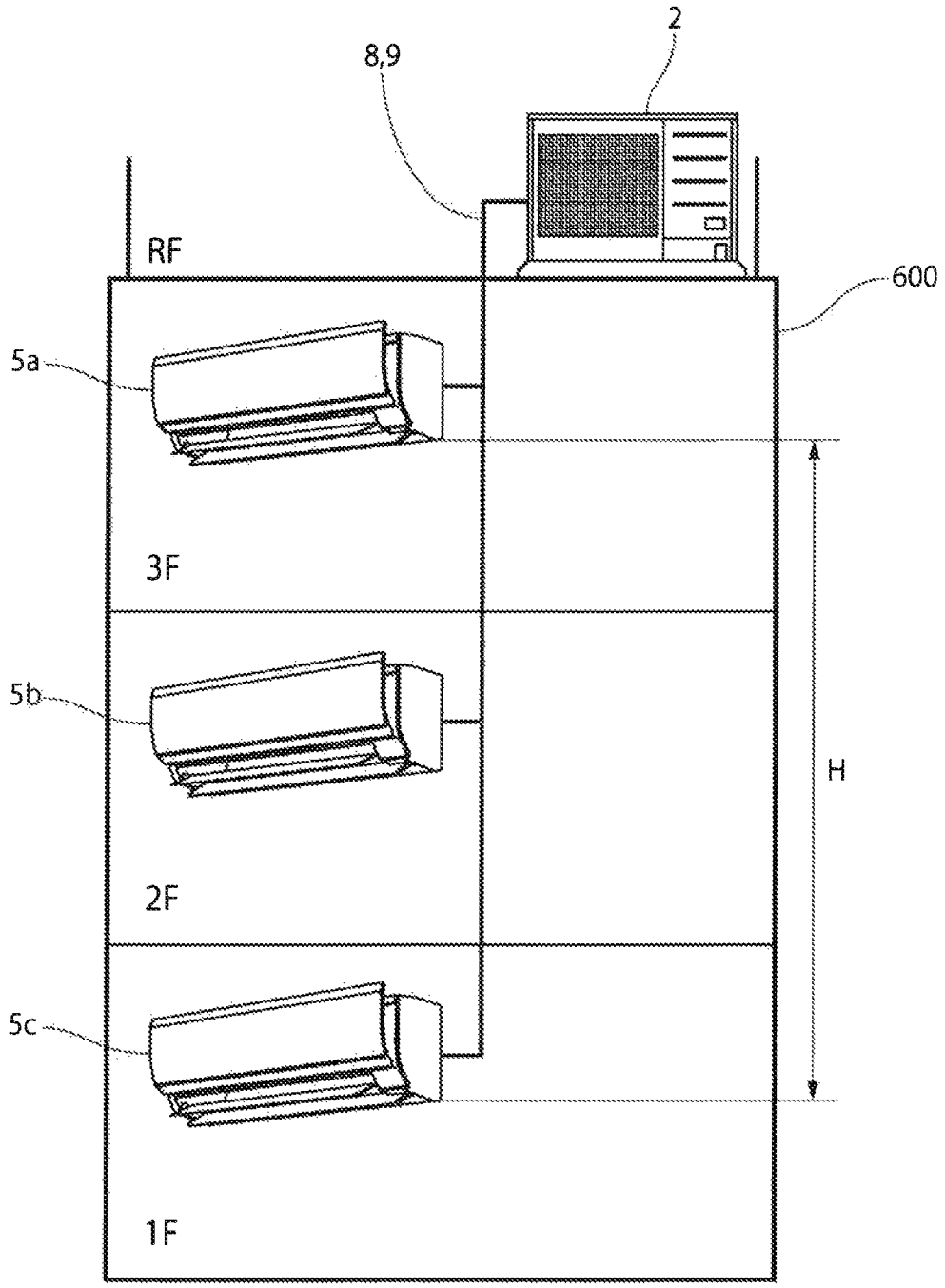
FIG. 2 is an installation diagram of indoor units and an outdoor unit in the embodiment of the present invention.

As shown in FIG. 1A and FIG. 2, an air conditioner 1 of the present embodiment is provided with one outdoor unit 2 installed on the roof of a building and three indoor units 5*a* to 5*c* installed on the floors of the building, respectively, and connected in parallel to the outdoor unit 2 by a liquid pipe 8 and a gas pipe 9. Specifically, the liquid pipe 8 has its one end connected to a closing valve 25 of the outdoor unit 2 and has its other end branched to be connected to liquid pipe connection portions 53*a* to 53*c* of the indoor units 5*a* to 5*c*. The gas pipe 9 has its one end connected to a closing valve 26 of the outdoor unit 2 and has its other end branched to be connected to gas pipe connection portions 54*a* to 54*c* of the indoor units 5*a* to 5*c*. This constitutes a refrigerant circuit 100 of the air conditioner 1.

First, the outdoor unit 2 will be described. The outdoor unit 2 is provided with a compressor 21, a four-way valve 22, an outdoor heat exchanger 23, an outdoor expansion valve 24, the closing valve 25 to which one end of the liquid pipe 8 is connected, the closing valve 26 to which one end of the gas pipe 9 is connected, an accumulator 28 as a refrigerant reservoir and an outdoor fan 27. These devices except the outdoor fan 27 are interconnected by refrigerant pipes described below in detail, thereby constituting an outdoor unit refrigerant circuit 20 forming part of the refrigerant circuit 100.

The compressor 21 is a variable ability compressor the operation capacity of which is variable by being driven by a non-illustrated motor the rpm of which is controlled by an inverter. The refrigerant discharge side of the compressor 21 is connected by a discharge pipe 41 to a port a of the four-way valve 22 described later, and the refrigerant suction side of the compressor 21 is connected to the refrigerant outflow side of the accumulator 28 by a suction pipe 42.

The four-way valve 22 is a valve for switching the direction in which the refrigerant flows, and is provided with four ports a, b, c and d. The port a is connected to the refrigerant discharge side of the compressor 21 by the discharge pipe 41 as mentioned above. The port b is connected to one refrigerant entrance and exit of the outdoor heat exchanger 23 by a refrigerant pipe 43. The port c is connected to the refrigerant inflow side of the accumulator 28 by a refrigerant pipe 46. The port d is connected to the closing valve 26 by an outdoor unit gas pipe 45.

The outdoor heat exchanger 23 performs heat exchange between the refrigerant and the outside air taken into the outdoor unit 2 by the rotation of the outdoor fan 27 described later. One refrigerant entrance and exit of the outdoor heat exchanger 23 is connected to the port b of the four-way valve 22 by the refrigerant pipe 43 as mentioned above, and the other refrigerant entrance and exit thereof is connected to the closing valve 25 by an outdoor unit liquid pipe 44.

The outdoor expansion valve 24 is provided on the outdoor unit liquid pipe 44. The outdoor expansion valve 24 is an electronic expansion valve, and by the degree of opening thereof being adjusted, the amount of refrigerant flowing into the outdoor heat exchanger 23 or the amount of refrigerant flowing out from the outdoor heat exchanger 23 is adjusted. The degree of opening of the outdoor expansion valve 24 is made full opening when the air conditioner 1 is performing cooling operation. When the air conditioner 1 is performing heating operation, by controlling the degree of opening thereof according to the discharge temperature of the compressor 21 detected by a discharge temperature sensor 33 described later, the discharge temperature is prevented from exceeding the performance upper value.

The outdoor fan 27 is made of a resin material, and disposed in the neighborhood of the outdoor heat exchanger 23. The outdoor fan 27 is rotated by a non-illustrated fan motor to thereby take the outside air into the outdoor unit 2 from a non-illustrated inlet, and discharges the outside air heat-exchanged with the refrigerant at the outdoor heat exchanger 23 from a non-illustrated outlet to the outside of the outdoor unit 2.

The accumulator 28, as mentioned above, has its refrigerant inflow side connected to the port c of the four-way valve 22 by the refrigerant pipe 46 and has its refrigerant outflow side connected to the refrigerant suction side of the compressor 21 by the suction pipe 42. The accumulator 28 separates the refrigerant having flown from the refrigerant pipe 46 into the accumulator 28 into a gas refrigerant and a liquid refrigerant and causes only the gas refrigerant to be sucked into the compressor 21.

In addition to the above-described components, various sensors are provided in the outdoor unit 2. As shown in FIG. 1A, the discharge pipe 41 is provided with a discharge pressure sensor 31 as the discharge pressure detector for detecting the discharge pressure which is the pressure of the refrigerant discharged from the compressor 21 and the discharge temperature sensor 33 that detects the temperature of the refrigerant discharged from the compressor 21. In the neighborhood of the refrigerant inflow port of the accumulator 28 on the refrigerant pipe 46, a suction pressure sensor 32 that detects the pressure of the refrigerant sucked into the compressor 21 and a suction temperature sensor 34 that detects the temperature of the refrigerant sucked into the compressor 21 are provided.

Between the outdoor heat exchanger 23 and the outdoor expansion valve 24 on the outdoor unit liquid pipe 44, a heat exchange temperature sensor 35 for detecting the temperature of the refrigerant flowing into the outdoor heat exchanger 23 or the temperature of the refrigerant flowing out from the outdoor heat exchanger 23 is provided. In the neighborhood of a non-illustrated inlet of the outdoor unit 2, an outside air temperature sensor 36 that detects the temperature of the outside air flowing into the outdoor unit 2, that is, the outside air temperature is provided.

Figure 1B:
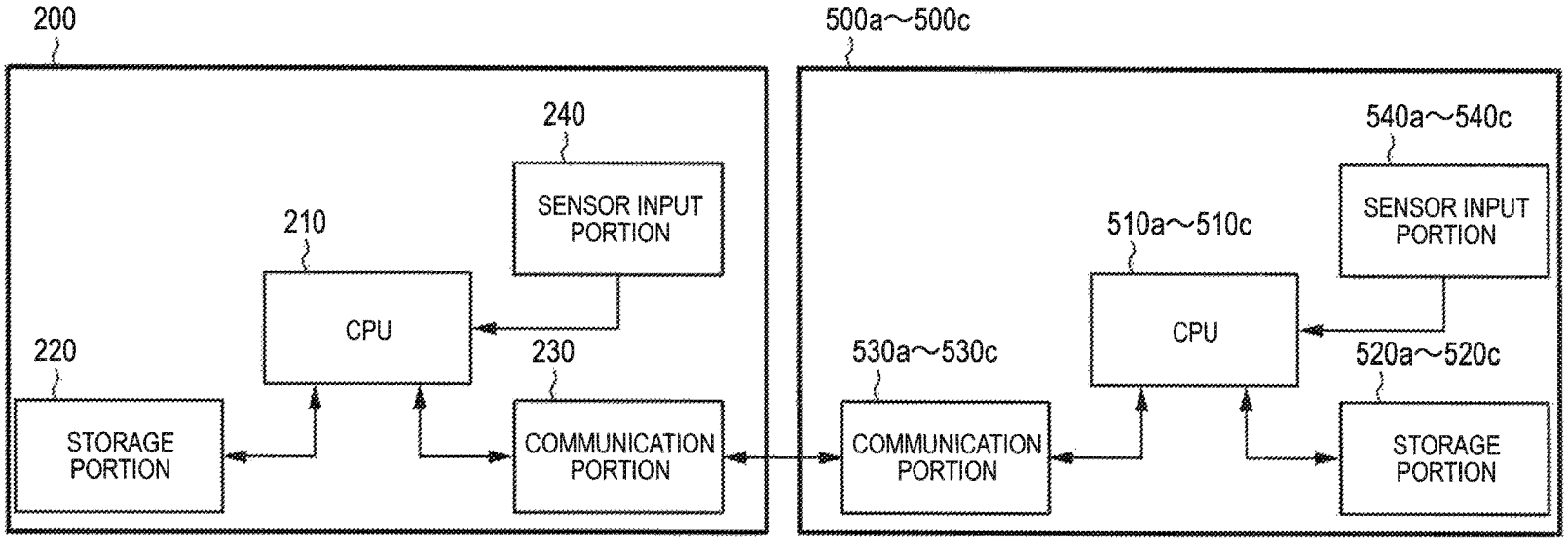
FIG. 1B is a block diagram of outdoor unit controller and indoor unit controller.

The outdoor unit 2 is provided with outdoor unit controller 200. The outdoor unit controller 200 is mounted on a control board housed in a non-illustrated electric component box of the outdoor unit 2. As shown in FIG. 1B, the outdoor unit controller 200 is provided with a CPU 210, a storage portion 220, a communication portion 230 and a sensor input portion 240.

The storage portion 220 is formed of a ROM and a RAM, and stores a control program of the outdoor unit 2, detection values corresponding to detection signals from various sensors, control states of the compressor 21 and the outdoor fan 27, and the like. The communication portion 230 is an interface that performs communication with the indoor units 5*a* to 5*c*. The sensor input portion 240 receives the results of the detections at the sensors of the outdoor unit 2 and outputs them to the CPU 210.

The CPU 210 receives the above-mentioned results of the detections at the sensors of the outdoor unit 2 through the sensor input portion 240. Moreover, the CPU 210 receives the control signals transmitted from the indoor units 5*a* to 5*c* through the communication portion 230. The CPU 210 controls driving of the compressor 21 and the outdoor fan 27 based on the received detection results and control signals. Moreover, the CPU 210 controls switching of the four-way valve 22 based on the received detection results and control signals. Further, the CPU 210 adjusts the degree of opening of the outdoor expansion valve 24 based on the received detection results and control signals.

Next, the three indoor units 5*a* to 5*c* will be described. The three indoor units 5*a* to 5*c* are provided with indoor heat exchangers 51*a* to 51*c*, indoor expansion valves 52*a* to 52*c*, the liquid pipe connection portions 53*a* to 53*c* to which the other ends of the branched liquid pipe 8 are connected, the gas pipe connection portions 54*a* to 54*c* to which the other ends of the branched gas pipe 9 are connected, and indoor fans 55*a* to 55*c*, respectively. These devices except the indoor fans 55*a* to 55*c* are interconnected by refrigerant pipes described below in detail, thereby constituting indoor unit refrigerant circuits 50*a* to 50*c* forming part of the refrigerant circuit 100. The three indoor units 5*a* to 5*c* all have the same ability, and if the refrigerant supercooling degree on the refrigerant exit side of the indoor heat exchangers 51*a* to 51*c* at the time of heating operation can be made not more than a predetermined value (for example, 10 deg.), sufficient heating ability can be displayed at each indoor unit.

The internal components of the indoor units 5*b* and 5*c* are the same as those of the indoor unit 5*a*. Therefore, in the following description, only the internal components of the indoor unit 5*a* are described, and description of the internal components of the other indoor units 5*b* and 5*c* is omitted. Moreover, in the circuit diagram shown in FIG. 1A, the internal components of the indoor units 5*b* and 5*c* are denoted by reference designations where the last letters of the reference designations assigned to the corresponding internal components of the indoor unit 5*a* are changed from a to b or c, respectively.

The indoor heat exchanger 51*a* performs heat exchange between the refrigerant and the indoor air taken into the indoor unit 5*a* from a non-illustrated inlet by the rotation of the indoor fan 55*a* described later, one refrigerant entrance and exit thereof is connected to the liquid pipe connection portion 53*a* by an indoor unit liquid pipe 71*a*, and the other refrigerant entrance and exit thereof is connected to the gas pipe connection portion 54*a* by an indoor unit gas pipe 72*a*. The indoor heat exchanger 51*a* functions as an evaporator when the indoor unit 5*a* performs cooling operation, and functions as a condenser when the indoor unit 5*a* performs heating operation.

To the liquid pipe connection portion 53*a* and the gas pipe connection portion 54*a*, the refrigerant pipes are connected by welding, flare nuts or the like.

The indoor expansion valve 52*a* is provided on the indoor unit liquid pipe 71*a*. The indoor expansion valve 52*a* is an electronic expansion valve, and when the indoor heat exchanger 51*a* functions as an evaporator, that is, when the indoor unit 5*a* performs cooling operation, the degree of opening thereof is adjusted so that the refrigerant supercooling degree at the refrigerant exit (the side of the gas pipe connection portion 54*a*) of the indoor heat exchanger 51*a* is a target refrigerant supercooling degree. Here, the target refrigerant supercooling degree is a refrigerant supercooling degree for sufficient cooling ability to be displayed at the indoor unit 5*a*. When the indoor heat exchanger 51*a* functions as a condenser, that is, when the indoor unit 5*a* performs heating operation, the degree of opening of the indoor expansion valve 52*a* is adjusted so that the refrigerant supercooling degree at the refrigerant exit (the side of the liquid pipe connection portion 53*a*) of the indoor heat exchanger 51*a* is an average refrigerant supercooling degree described later.

The indoor fan 55*a* is made of a resin material, and disposed in the neighborhood of the indoor heat exchanger 51*a*. The indoor fan 55*a* is rotated by a non-illustrated fan motor to thereby take the indoor air into the indoor unit 5*a* from a non-illustrated inlet, and supplies the indoor air heat-exchanged with the refrigerant at the indoor heat exchanger 51*a* from a non-illustrated outlet into the room.

In addition to the above-described components, various sensors are provided in the indoor unit 5*a*. Between the indoor heat exchanger 51*a* and the indoor expansion valve 52*a* on the indoor unit liquid pipe 71*a*, a liquid side temperature sensor 61*a* as the liquid side temperature detector for detecting the temperature of the refrigerant flowing into the indoor heat exchanger 51*a* or flowing out from the indoor heat exchanger 51*a* is provided. The indoor unit gas pipe 72*a* is provided with a gas side temperature sensor 62*a* that detects the temperature of the refrigerant flowing out from the indoor heat exchanger 51*a* or flowing into the indoor heat exchanger 51*a*. In the neighborhood of a non-illustrated inlet of the indoor unit 5*a*, an inflow temperature sensor 63*a* as inflow temperature detector for detecting the temperature of the indoor air flowing into the indoor unit 5*a*, that is, the inflow temperature is provided. In the neighborhood of a non-illustrated outlet of the indoor unit 5*a*, an outflow temperature sensor 64*a* as outflow temperature detector for detecting the temperature of the air heat-exchanged with the refrigerant at the indoor heat exchanger 51*a* and discharged from the indoor unit 5*a* into the room, that is, the outflow temperature is provided.

The indoor unit 5*a* is provided with indoor unit controller 500*a*. The indoor unit controller 500*a* is mounted on a control board housed in a non-illustrated electric component box of the indoor unit 5*a*, and as shown in FIG. 1B, is provided with a CPU 510*a*, a storage portion 520*a*, a communication portion 530*a* and a sensor input portion 540*a*.

The storage portion 520*a* is formed of a ROM and a RAM, and stores a control program of the indoor unit 5*a*, detection values corresponding to detection signals from various sensors, setting information related to an air-conditioning operation by the user, and the like. The communication portion 530*a* is an interface that performs communication with the outdoor unit 2 and the other indoor units 5*b* and 5*c*. The sensor input portion 540*a* receives the results of the detections at the sensors of the indoor unit 5*a* and outputs them to the CPU 510*a*.

The CPU 510*a* receives the above-mentioned results of the detections at the sensors of the indoor unit 5*a* through the sensor input portion 540*a*. Moreover, the CPU 510*a* receives, through a non-illustrated remote control light receiving portion, a signal containing operation information, timer operation setting and the like set by the user operating a non-illustrated remote control unit. Moreover, the CPU 510*a* transmits an operation start/stop signal and a control signal containing operation information (the set temperature, the room temperature, etc.) to the outdoor unit 2 through the communication portion 530*a*, and receives a control signal containing information such as the discharge pressure detected by the outdoor unit 2 from the outdoor unit 2 through the communication portion 530*a*. The CPU 510*a* adjusts the degree of opening of the indoor expansion valve 52*a* and controls driving of the indoor fan 55*a* based on the received detection results and the signals transmitted from the remote control unit and the outdoor unit 2.

The above-described outdoor unit controller 200 and the indoor unit controller 500*a* to 500*c* constitute the controller of the present invention.

The above-described air conditioner 1 is installed in a building 600 shown in FIG. 2. Specifically, the outdoor unit 2 is installed on the roof (RF); the indoor unit 5*a*, on the third floor; the indoor unit 5*b*, on the second floor; and the indoor unit 5*c*, on the first floor. The outdoor unit 2 and the indoor units 5*a* to 5*c* are interconnected by the above-described liquid pipe 8 and gas pipe 9, and these liquid pipe 8 and gas pipe 9 are buried in a non-illustrated wall or ceiling of the building 600. In FIG. 2, the difference in height between the indoor unit 5*a* installed on the highest floor (the third floor) and the indoor unit 5*c* installed on the lowest floor (the first floor) is represented as H.

Next, the flow of the refrigerant at the refrigerant circuit 100 and the operations of components at the time of the air-conditioning operation of the air conditioner 1 of the present embodiment will be described by using FIG. 1A. In the following description, a case where the indoor units 5*a* to 5*c* perform heating operation will be described, and detailed description of a case where they perform cooling/defrosting operation is omitted. The arrows in FIG. 1A indicate the flow of the refrigerant at the time of heating operation.

As shown in FIG. 1A, when the indoor units 5*a* to 5*c* perform heating operation, the CPU 210 of the outdoor unit controller 200 switches the four-way valve 22 to the state shown by the solid lines, that is, so that the port a and the port d of the four-way valve 22 communicate with each other and that the port b and the port c communicate with each other. This brings the refrigerant circuit 100 into a heating cycle where the outdoor heat exchanger 23 functions as an evaporator and the indoor heat exchangers 51*a* to 51*c* function as condensers.

The high-pressure refrigerant discharged from the compressor 21 flows through the discharge pipe 41 into the four-way valve 22, and flows from the four-way valve 22 through the outdoor unit gas pipe 45, the closing valve 26, the gas pipe 9 and the gas pipe connection portions 54*a* to 54*c* in this order into the indoor units 5*a* to 5*c*. The refrigerant having flown into the indoor units 5*a* to 5*c* flows through the indoor unit gas pipes 72*a* to 72*c* into the indoor heat exchangers 51*a* to 51*c*, exchanges heat with the indoor air taken into the indoor units 5*a* to 5*c* by the rotation of the indoor fans 55*a* to 55*c* and condensed. As described above, the indoor heat exchangers 51*a* to 51*c* function as condensers and the indoor air heat-exchanged with the refrigerant at the indoor heat exchangers 51*a* to 51*c* is flown out form a non-illustrated outlet into the rooms, thereby performing heating in the rooms where the indoor units 5*a* to 5*c* are installed.

The refrigerant having flown out from the indoor heat exchangers 51*a* to 51*c* flows through the indoor unit liquid pipes 71*a* to 71*c*, and passes through the indoor expansion valves 52*a* to 52*c* to be depressurized. The depressurized refrigerant flows through the indoor unit liquid pipes 71*a* to 71*c* and the liquid pipe connection portions 53*a* to 53*c* into the liquid pipe 8.

The refrigerant flowing through the liquid pipe 8 flows into the outdoor unit 2 through the closing valve 25. The refrigerant having flown into the outdoor unit 2 flows through the outdoor unit liquid pipe 44, and is further depressurized when passing through the outdoor expansion valve 24 the degree of opening of which is set to a value corresponding to the discharge temperature of the compressor 21 detected by the discharge temperature sensor 33. The refrigerant having flown from the outdoor unit liquid pipe 44 into the outdoor heat exchanger 23 exchanges heat with the outside air taken into the outdoor unit 2 by the rotation of the outdoor fan 27 and evaporated. The refrigerant having flown out from the outdoor heat exchanger 23 flows through the refrigerant pipe 43, the four-way valve 22, the refrigerant pipe 46, the accumulator 28 and the suction pipe 42 in this order to be sucked by the compressor 21 and compressed again.

When the indoor units 5*a* to 5*c* perform cooling/defrosting operation, the CPU 210 switches the four-way valve 22 to the state shown by the broken line, that is, so that the port a and the port b of the four-way valve 22 communicate with each other and that the port c and the port d communicate with each other. This brings the refrigerant circuit 100 into a cooling cycle where the outdoor heat exchanger 23 functions as a condenser and the indoor heat exchangers 51*a* to 51*c* function as evaporators.

Figure 3:
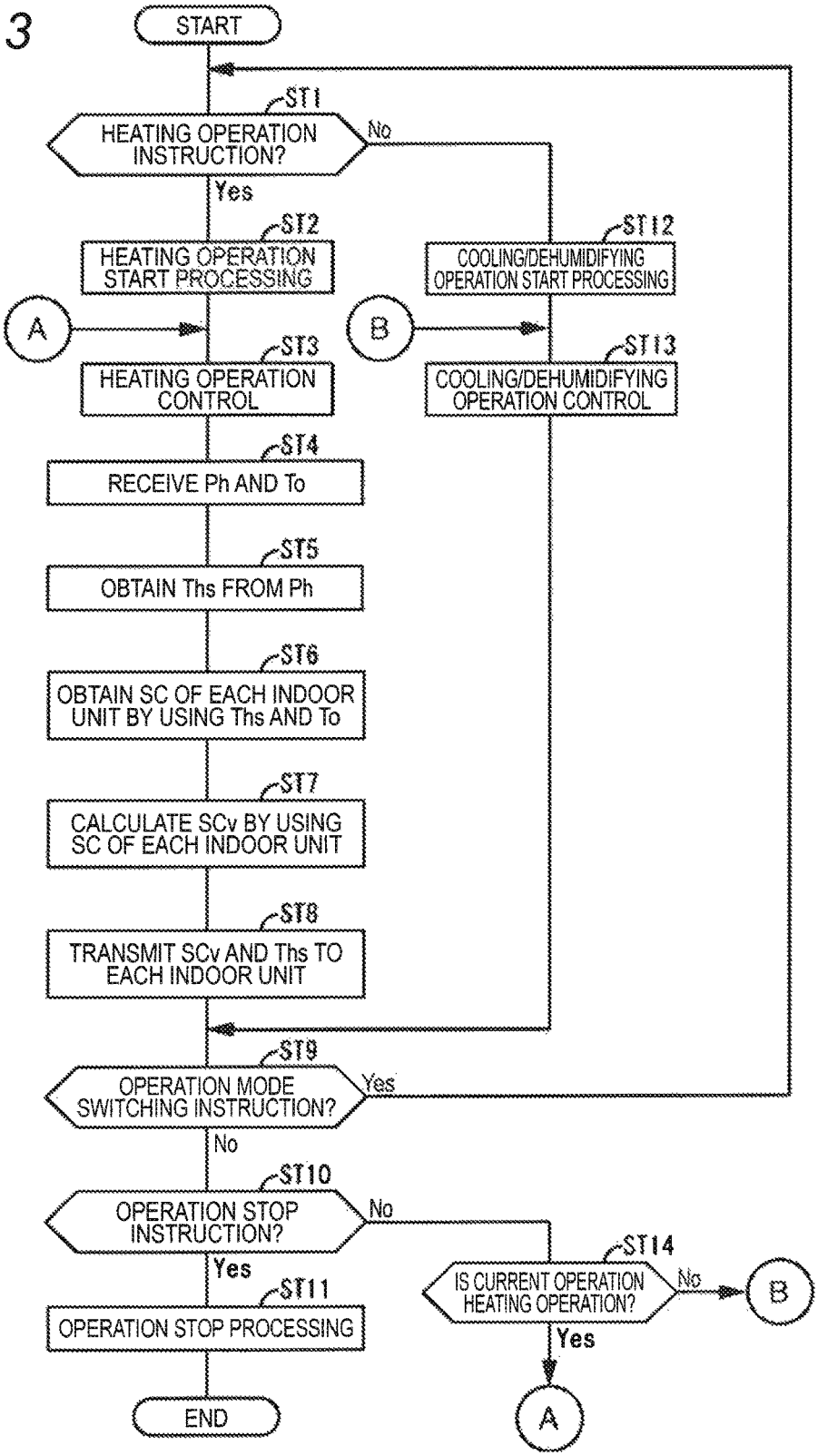
FIG. 3 is a flowchart explaining processing at the outdoor control portion in the embodiment of the present invention.

Next, the operation, workings and effects of the refrigerant circuit related to the present invention in the air conditioner 1 of the present embodiment will be described by using FIGS. 1 to 3. The liquid side temperature sensors 61*a* to 61*c* when the indoor heat exchanger 51*a* functions as a condenser are heat exchange exit temperature sensors of the present invention.

As shown in FIG. 2, in the air conditioner 1 of the present embodiment, the outdoor unit 2 is installed on the roof of the building 600 and the indoor units 5*a* to 5*c* are installed on the floors, respectively. That is, the outdoor unit 2 is installed in a higher position than the indoor units 5*a* to 5*c*, and there is a height difference H between the installation positions of the indoor unit 5*a* and the indoor unit 5*c*. In this case, the following problem arises when heating operation is performed by the air conditioner 1.

In heating operation, the gas refrigerant discharged from the compressor 21 flows from the discharge pipe 41 through the outdoor unit gas pipe 45 by way of the four-way valve 22 to be flown out from the outdoor unit 2, and flows into the indoor heat exchangers 51*a* to 51*c* of the indoor units 5*a* to 5*c* to be condensed. At this time, since the outdoor unit 2 is installed in the higher position than the indoor units 5*a* to 5*c*, the liquid refrigerant condensed at the indoor heat exchangers 51*a* to 51*c* and having flown out into the liquid pipe 8 flows through the liquid pipe 8 against gravity toward the outdoor unit 2.

Therefore, since it becomes more difficult for the liquid refrigerant having flown out into the liquid pipe 8 to flow toward the outdoor unit 2 as the installation positions of the indoor units 5*a* to 5*c* become low compared with that of the outdoor unit 2, the pressure of the liquid refrigerant on the downstream side (the side of the outdoor unit 2) of the indoor expansion valve 52*c* of the indoor unit 5*c* installed on the first floor is higher than the pressure of the liquid refrigerant on the downstream of the indoor expansion valves 52*a* and 52*b* of the indoor units 5*a* and 5*b* installed on the other floors. For this reason, the difference between the refrigerant pressure on the upstream side (the side of the indoor heat exchanger 51*c*) of the indoor expansion valve 52*c* of the indoor unit 5*c* and the refrigerant pressure on the downstream side thereof is small compared with the difference between the refrigerant pressure on the upstream side of the indoor expansion valves 52*a* and 52*b* of the indoor units 5*a* and 5*b* and the refrigerant pressure on the downstream side thereof.

In the state of the refrigerant circuit 100 as described above, the smaller the difference between the refrigerant pressure on the upstream side of the indoor expansion valves 52*a* to 52*c* and the refrigerant pressure on the downstream side thereof, the smaller the amount of refrigerant flowing through the indoor expansion valves 52*a* to 52*c*. Therefore, the amount of refrigerant flowing in the indoor unit 5*c* installed on the first floor is small compared with the amounts of refrigerant flowing in the other indoor units 5*a* and 5*b*. This becomes more conspicuous as the height difference H between the indoor unit 5*c* installed on the first floor (the lowest position) and the indoor unit 5*a* installed on the third floor (the highest position) increases, and if the height difference increases (for example, 50 m), there is a possibility that the liquid refrigerant having flown out from the indoor unit 5*c* into the liquid pipe 8 does not flow toward the outdoor unit 2 and stays below the liquid pipe 8. If the liquid refrigerant stays below the liquid pipe 8, there is a possibility that even if the indoor unit 5*c* is fully opened, no refrigerant flows in the indoor unit 5*c* and no heating ability is displayed at the indoor unit 5*c* consequently.

Accordingly, in the present invention, when the air conditioner 1 performs heating operation, the refrigerant supercooling degree on the refrigerant exit side of the indoor expansion valves 52*a* to 52*c* of the indoor units 5*a* to 5*c* (the side of the indoor expansion valves 52*a* to 52*c*) is calculated periodically (for example, every thirty seconds), the maximum value and the minimum value of the calculated refrigerant supercooling degrees are extracted, and an average refrigerant supercooling degree which is the average value of these is obtained. Then, a refrigerant amount balance control is executed in which the degrees of opening of the indoor expansion valves 52*a* to 52*c* of the indoor units 5*a* to 5*c* are adjusted so that the refrigerant supercooling degree on the refrigerant exit side of the indoor heat exchangers 51*a* to 51*c* becomes the obtained average refrigerant supercooling degree.

When the liquid refrigerant stays below the liquid pipe 8 so that even if the indoor unit 5*c* is fully opened, no refrigerant flows in the indoor unit 5*c* and no heating ability is displayed at the indoor unit 5*c*, the refrigerant supercooling degrees of the indoor units 5*a* to 5*c* increase as the installation positions thereof become lower from the outdoor unit 2 such as 6 deg. in the indoor unit 5*a*, 10 deg. in the indoor unit 5*b* and 20 deg., in the indoor unit 5*c*. Moreover, by the liquid refrigerant staying below the liquid pipe 8, the overall refrigerant circulation amount of the refrigerant circuit 100 is insufficient.

When the refrigerant amount balance control is executed in the state of the refrigerant circuit 100 as described above, in the indoor units 5*a* and 5*b* where the refrigerant supercooling degree is lower than the average refrigerant supercooling degree (in the case of the above-described example, 13 deg. which is the average value of the maximum value: 20 deg. and the minimum value: 6 deg.), since the degrees of opening of the indoor expansion valves 52*a* and 52*b* are decreased in order to increase the refrigerant supercooling degree to the average refrigerant supercooling degree, the refrigerant pressure on the downstream side of the indoor expansion valves 52*a* and 52*b* decreases.

At this time, in the indoor unit 5*c* where the refrigerant supercooling degree is higher than the average refrigerant supercooling degree, since the refrigerant pressure on the downstream side of the indoor expansion valves 52*a* and 52*b* decreases and this decreases the refrigerant pressure on the downstream side of the indoor expansion valve 52*c*, the difference in pressure between on the upstream side and on the downstream side of the indoor expansion valve 52*c* increases. Consequently, when the degree of opening of the indoor expansion valve 52*c* is made high in order to decrease the refrigerant supercooling degree of the indoor unit 5*c* to the average refrigerant supercooling degree in the refrigerant amount balance control, even if the degree of opening thereof is full opening, the liquid refrigerant staying at the indoor heat exchanger 51*c* of the indoor unit 5*c* flows out into the liquid pipe 8, so that the heating ability of the indoor unit 5*c* increases.

In the indoor units 5*a* and 5*b*, the degrees of opening of the indoor expansion valves 52*a* and 52*b* are decreased and the amounts of liquid refrigerant staying at the indoor heat exchangers 51*a* and 51*b* are large compared with when the refrigerant amount balance control is not performed, so that the heating ability temporarily decreases in the indoor units 5*a* and 5*b*. However, if the refrigerant amount balance control is executed, the liquid refrigerant staying at the indoor unit 5*c* flows out into the refrigerant circuit 100, so that the overall refrigerant circulation amount of the refrigerant circuit 100 increases to make the amount of circulating refrigerant of the refrigerant circuit 100 sufficient. Since this makes the average refrigerant supercooling degree lower than a predetermined refrigerant supercooling degree (for example, the above-mentioned 10 deg.) where sufficient heating ability can be displayed at each indoor unit, sufficient heating ability can be displayed at all the indoor units.

Next, the control at the time of heating operation in the air conditioner 1 of the present embodiment will be described by using FIG. 3. FIG. 3 shows the flow of the processing related to the control performed by the CPU 210 of the outdoor unit controller 200 when the air conditioner 1 performs heating operation. In FIG. 3, ST represents a step, and the number following this represents the step number. In FIG. 3, the processing related to the present invention is mainly described, and description of processing other than this, for example, general processing related to the air conditioner 1 such as control of the refrigerant circuit 100 corresponding to the operation conditions such as the set temperature and air volume specified by the user is omitted. In the following description, a case where all the indoor units 5*a* to 5*c* are performing heating operation will be described as an example.

Moreover, in the following description, the discharge pressure of the compressor 21 detected by the discharge pressure sensor 31 of the outdoor unit 2 is designated as Ph; the high-pressure saturation temperature obtained by using the discharge pressure Ph, as Ths; the heat exchange exit temperature detected by the liquid side temperature sensors 61*a* to 61*c* of the indoor units 5*a* to 5*c*, as To (designated as Toa to Toc when it is necessary to mention it individually for each indoor unit); the refrigerant supercooling degree on the refrigerant exit side of the indoor heat exchangers 51*a* to 51*c* obtained by subtracting the heat exchange exit temperature To from the high-pressure saturation temperature Ths, as SC (designated as SCa to SCc when it is necessary to mention it individually for each indoor unit); and the average refrigerant supercooling degree obtained by using the maximum value and the minimum value of the refrigerant supercooling degrees SC at the indoor units, as SCv.

First, the CPU 210 determines whether the user's operation instruction is a heating operation instruction or not (ST1). When it is not a heating operation instruction (ST1—No), the CPU 210 executes cooling/dehumidifying operation start processing which is the processing to start cooling operation or dehumidifying operation (ST12). Here, the cooling/dehumidifying operation start processing is that the CPU 210 operates the four-way valve 22 to bring the refrigerant circuit 100 into the cooling cycle, and is the processing performed when cooling operation or dehumidifying operation is performed first. Then, the CPU 210 starts the compressor 21 and the outdoor fan 27 at predetermined rpm, instructs the indoor units 5*a* to 5*c*, through the communication portion 230, to control driving of the indoor fans 55*a* to 55*c* and adjust the degrees of opening of the indoor expansion valves 52*a* to 52*c* to thereby start control of cooling operation or dehumidifying operation (ST13), and advances the process to ST9.

At ST1, when it is a heating operation instruction (ST1—Yes), the CPU 210 executes heating operation start processing (ST2). Here, the heating operation start processing is that the CPU 210 operates the four-way valve 22 to bring the refrigerant circuit 100 into the state shown in FIG. 1A, that is, bring the refrigerant circuit 100 into the heating cycle, and is the processing performed when heating operation is performed first.

Then, the CPU 210 performs the heating operation start processing (ST3). In the heating operation start processing, the CPU 210 starts the compressor 21 and the outdoor fan 27 at rpm corresponding to the ability required from the indoor units 5*a* to 5*c*. Moreover, the CPU 210 receives the discharge temperature of the compressor 21 detected by the discharge temperature sensor 33 through the sensor input portion 240, and adjusts the degree of opening of the outdoor expansion valve 24 according to the received discharge temperature. Further, the CPU 210 transmits an operation start signal indicating the start of heating operation to the indoor units 5*a* to 5*c* through the communication portion 230.

The CPUs 510*a* to 510*c* of the indoor unit controller 500*a* to 500*c* of the indoor units 5*a* to 5*c* having received the operation start signal through the communication portions 530*a* to 530*c* start the indoor fans 55*a* to 55*c* at rpm corresponding to the user's air volume instruction, and adjust the degrees of opening of the indoor expansion valves 52*a* to 52*c* so that the refrigerant supercooling degrees at the refrigerant exits (the side of the liquid pipe connection portions 53*a* to 53*c*) of the indoor heat exchangers 51*a* to 51*c* become a target refrigerant supercooling degree at the time of start of operation (for example, 6 deg.). Here, the target refrigerant supercooling degree is a value previously obtained by performing a test or the like and stored in the communication portions 530*a* to 530*c*, and is a value where it has been confirmed that heating ability is sufficiently displayed at each indoor unit. During the time from the start of heating operation to when the state of the refrigerant circuit 100 is stabilized (for example, three minutes from the start of operation), the CPUs 510*a* to 510*c* adjust the degrees of opening of the indoor expansion valves 52*a* to 52*c* so that the refrigerant supercooling degrees become the above-mentioned target refrigerant degree at the time of start of operation.

Then, the CPU 210 receives the discharge pressure Ph detected by the discharge pressure sensor 31 through the sensor input portion 240, and receives the heat exchange exit temperatures To (Toa to Toe) from the indoor units 5*a* to 5*c* through the communication portion 230 (ST4). The heat exchange exit temperatures To are the detection values at the liquid side temperature sensors 61*a* to 61*c* that the CPUs 510*a* to 510*c* receive at the indoor units 5*a* to 5*c* and transmit to the outdoor unit 2 through the communication portions 530*a* to 530*c*. The above-mentioned detection values are received by the CPUs every predetermined time (for example, every 30 seconds) and stored in the storage portions.

Then, the CPU 210 obtains the high-pressure saturation temperature Ths by using the discharge pressure Ph received at ST4 (ST5), and obtains the refrigerant supercooling degrees SC of the indoor units 5*a* to 5*c* by using the obtained high-pressure saturation temperature Ths and the heat exchange exit temperature To received at ST4 (ST6).

Then, the CPU 210 calculates the average refrigerant supercooling degree SCv by using the refrigerant supercooling degrees SC of the indoor units 5*a* to 5*c* obtained at ST6 (ST7). Specifically, the CPU 210 extracts the maximum value and the minimum value of the refrigerant supercooling degrees SCa to SCc of the indoor units 5*a* to 5*c*, obtains the average value of these and sets it as the average refrigerant supercooling degree SCv.

Then, the CPU 210 transmits the average refrigerant supercooling degree SCv obtained at ST7 and the high-pressure saturation temperature Ths obtained at ST5 to the indoor units 5*a* to 5*c* through the communication portion 230 (ST8). The CPUs 510*a* to 510 of the indoor units 5*a* to 5*c* having received the average refrigerant supercooling degree SCv and the high-pressure saturation temperature Ths through the communication portions 530*a* to 530*c* obtain the refrigerant supercooling degrees SCa to SCc by subtracting the heat exchange exit temperatures Toa to Toe detected by the liquid side temperature sensors 61*a* to 61*c* from the high-pressure saturation temperature Ths received from the outdoor unit 2, and adjust the degrees of opening of the indoor expansion valves 52*a* to 52*c* so that the obtained refrigerant supercooling degrees SCa to SCc become the average refrigerant supercooling degree SCv received from the outdoor unit 2.

The above-described processing from ST4 to ST8 is the processing related to the refrigerant amount balance control of the present invention.

The CPU 210 having finished the processing of ST8 determines whether there is an operation mode switching instruction by the user or not (ST9). Here, the operation mode instruction is an instruction to switch from the current operation (in this description, heating operation) to another operation (cooling operation or dehumidifying operation). When there is an operation mode switching instruction (ST9—Yes), the CPU 210 returns the process to ST1. When there is no operation mode switching instruction (ST9—No), the CPU 210 determines whether there is an operation stop instruction by the user or not (ST10). The operation stop instruction is an instruction to stop the operation of all the indoor units 5*a* to 5*c*.

When there is an operation stop instruction (ST10—Yes), the CPU 210 executes operation stop processing (ST11), and ends the process. In the operation stop processing, the CPU 210 stops the compressor 21 and the outdoor fan 27 and fully closes the outdoor expansion valve 24. Moreover, the CPU 210 transmits an operation stop signal indicative of the stop of operation to the indoor units 5*a* to 5*c* through the communication portion 230. The CPUs 510*a* to 510*c* of the indoor units 5*a* to 5*c* having received the operation stop signal through the communication portions 530*a* to 530*c* stop the indoor fans 55*a* to 55*c* and fully close the indoor expansion valves 52*a* to 52*c*.

When there is no operation stop instruction at ST10 (ST10—No), the CPU 210 determines whether the current operation is heating operation or not (ST14). When the current operation is heating operation (ST14—Yes), the CPU 210 returns the process to ST3. When the current operation is not heating operation (ST14—No), that is, when the current operation is cooling operation or dehumidifying operation, the CPU 210 returns the process to ST13.

Second Embodiment

Next, a second embodiment of the present invention will be described by using mainly FIG. 4. What is different from the first embodiment is that in the second embodiment, the refrigerant amount balance control is executed from the point of time when it is determined that there is an indoor unit where heating ability is not displayed whereas in the first embodiment, the refrigerant amount balance control is executed from the time of start of heating operation (precisely, from when the refrigerant circuit 100 is stabilized). Detailed description of points other than this, that is, the components of the air conditioner 1 and the state of the refrigerant circuit 100 at the time of heating operation is omitted since it is the same as that of the first embodiment.

As described in the first embodiment, if the refrigerant amount balance control is executed, in the indoor unit where the refrigerant supercooling degree is higher than the average refrigerant supercooling degree of the indoor units 5*a* to 5*c* (in the first embodiment, the indoor unit 5*c*), the refrigerant staying in the indoor unit flows out and heating ability increases. On the other hand, in the indoor unit where the refrigerant supercooling degree is lower than the average refrigerant supercooling degree (in the first embodiment, the indoor units 5*a* to 5*b*), the flow amount of the refrigerant in the indoor heat exchanger of the indoor unit decreases compared with when the refrigerant amount balance control is not performed, and heating ability temporarily decreases. That is, in order that heating ability is displayed in the indoor unit installed below where heating ability is not displayed, heating ability is temporarily decreased in the indoor unit installed above the indoor unit.

In the first embodiment, the refrigerant amount balance control is executed from the time of start of heating operation. Consequently, since the refrigerant amount balance control is executed irrespective of whether there is an indoor unit where heating ability is not displayed or not, if the refrigerant amount balance control is executed when there is no indoor unit where heating ability is not displayed, heating ability is unnecessarily decreased in the indoor unit where heating ability is displayed.

On the contrary, in the second embodiment, whether there is an indoor unit where heating ability is not displayed or not is determined by a method described below, and the refrigerant amount balance control is executed only when there is an indoor unit where heating ability is not displayed. Thereby, while the heating ability of the indoor unit where heating ability is displayed is prevented from being decreased more than necessary at the time of heating operation, when there is an indoor unit where heating ability is not displayed, the heating ability of the indoor unit can be increased.

The determination as to the presence or absence of an indoor unit where heating ability is not displayed is performed, for example, as follows: First, the CPU 210 of the outdoor unit 2 obtains the refrigerant supercooling degrees SCa to SCc of the indoor units 5*a* to 5*c* by subtracting the heat exchange exit temperatures Toa to Toc received from the indoor units 5*a* to 5*c* through the communication portion 230, from the high-pressure saturation temperature Ths obtained by using the discharge pressure Ph received from the discharge pressure sensor 31 through the sensor input portion 240. When there is an indoor unit where the obtained refrigerant supercooling degrees SCa to SCc of the indoor units 5*a* to 5*c* are higher than a predetermined refrigerant supercooling degree (for example, 20 deg. C.), the CPU 210 determines that heating ability is displayed at the indoor unit.

Next, the control at the time of heating operation in the air conditioner 1 of the present embodiment will be described by using FIG. 4. FIG. 4 shows the flow of the processing related to the control performed by the CPU 210 of the outdoor unit controller 200 when the air conditioner 1 performs heating operation. In FIG. 4, ST represents a step, and the number following this represents the step number. In FIG. 4, the processing related to the present invention is mainly described, and description of processing other than this, for example, general processing related to the air conditioner 1 such as control of the refrigerant circuit 100 corresponding to the operation conditions such as the set temperature and air volume specified by the user is omitted. In the following description, a case where all the indoor units 5*a* to 5*c* are performing heating operation will be described as an example as in the first embodiment.

Figure 4:
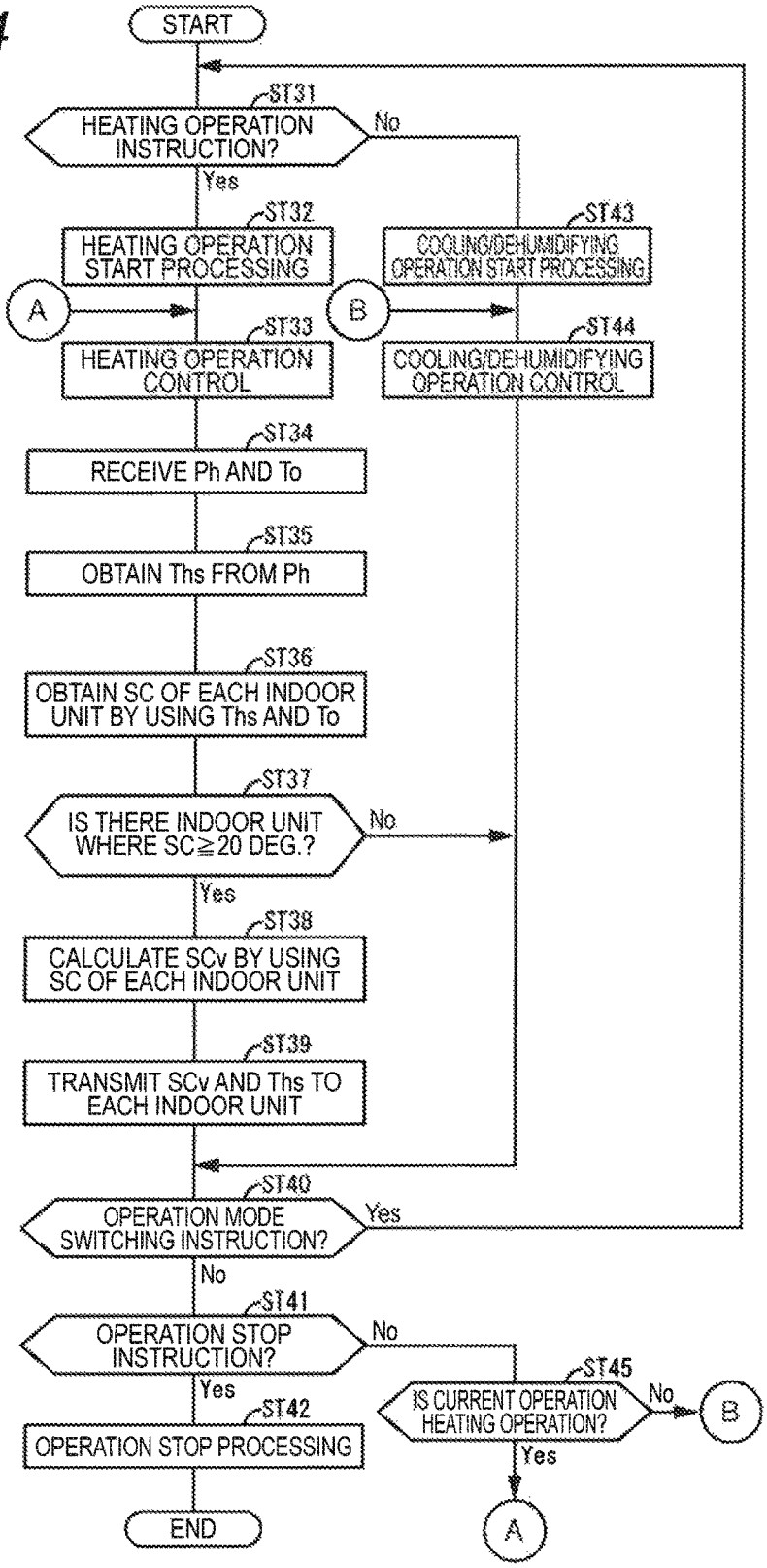
FIG. 4 is a flowchart explaining processing at the outdoor unit control portion in another embodiment of the present invention.

Since the flowchart shown in FIG. 4 is the same processing as the flowchart shown in FIG. 3 described in the first embodiment except the processing of ST34, ST35 and ST37, detailed description thereof is omitted, and only the processing of ST34, ST35 and ST37 will be described here.

At ST34, the CPU 210 receives the discharge pressure Ph detected by the discharge pressure sensor 31 through the sensor input portion 240, and receives the heat exchange exit temperatures To (Toa to Toe) from the indoor units 5*a* to 5*c* through the communication portion 230. The heat exchange exit temperatures To are the detection values at the liquid side temperature sensors 61*a* to 61*c* that the CPUs 510*a* to 510*c* receive at the indoor units 5*a* to 5*c* and transmit to the outdoor unit 2 through the communication portions 530*a* to 530*c*. The above-mentioned detection values are received by the CPUs every predetermined time (for example, every 30 seconds) and stored in the storage portions.

Then, the CPU 210 obtains the high-pressure saturation temperature Ths by using the discharge pressure Ph received at ST34 (ST35), and advances the process to ST36. The CPU 210 having calculated the refrigerant supercooling degrees SCa to SCc of the indoor units 5*a* to 5*c* at the processing of ST36 determines whether there is an indoor unit where the calculated refrigerant supercooling degrees SCa to SCc are not less than 20 deg. or not (ST37), that is, determines whether there is an indoor unit where heating ability is displayed or not.

When there is no indoor unit where the refrigerant supercooling degrees SCa to SCc are not less than 20 deg. (ST37—No), the CPU 210 advances the process to ST40. In this case, the CPUs 510*a* to 510*c* of the indoor units 5*a* to 5*c* adjust the degrees of opening of the indoor expansion valves 52*a* to 52*c* so that the refrigerant supercooling degrees become the target refrigerant supercooling degree (for example, 6 deg.) at the time of start of heating operation.

When there is an indoor unit where the refrigerant supercooling degrees SCa to SCc are not less than 20 deg. (ST37—Yes), the CPU 210 calculates the average refrigerant supercooling degree SCv by using the refrigerant supercooling degrees SCa to SCc of the indoor units 5*a* to 5*c* obtained at ST36 (ST38), transmits the average refrigerant supercooling degree SCv and the high-pressure saturation temperature Ths obtained at ST35 to the indoor units 5*a* to 5*c* through the communication portion 230 (ST39), and advances the process to ST40.

The above-described processing from ST34 to ST39 is the processing related to the refrigerant amount balance control in the second embodiment of the present invention.

As described above, the air conditioner 1 of the present invention executes the refrigerant amount balance control to adjust the degrees of opening of the indoor expansion valves 52*a* to 52*c* so that the refrigerant supercooling degrees SCa to SCc at the indoor units 5*a* to 5*c* become the average refrigerant supercooling degree SCv obtained by using the maximum value and the minimum value of these. Thereby, since the refrigerant staying in an indoor unit where heating ability is not displayed flows out from the indoor unit, the heating ability of the indoor unit increases.

While in the above-described embodiments, a case is described where the refrigerant amount balance control is executed by using the refrigerant supercooling degrees of the indoor units, the refrigerant amount balance control may be executed by using the heat exchange exit temperatures of the indoor heat exchangers of the indoor units detected by the liquid side temperature detector (the liquid side temperature sensors 61*a* to 61*c*) as described above instead of the refrigerant supercooling degrees. When the refrigerant amount balance control is executed by using the heat exchange exit temperatures, the degrees of opening of the indoor expansion valves are adjusted so that the heat exchange exit temperatures of the indoor units become the average heat exchange exit temperature obtained by using the maximum value and the minimum value of these heat exchange exit temperatures.

Moreover, while in the second embodiment, the presence or absence of an indoor unit where heating ability is not displayed is determined by using the refrigerant supercooling degrees of the indoor units and the difference between the outflow temperature and the inflow temperature at each indoor unit, the presence or absence of an indoor unit where heating ability is not displayed may be determined by using the heat exchange exit temperatures of the indoor units and the difference between the outflow temperature and the inflow temperature at each indoor unit instead of the refrigerant supercooling degrees. When the heat exchange exit temperatures of the indoor units are used, an indoor unit where the heat exchange exit temperature is, for example, not more than the inflow temperature and the difference between the outflow temperature and the inflow temperature is smaller than a predetermined temperature difference is determined as an indoor unit where heating ability is not displayed.

The invention claimed is:

1. An air conditioner comprising:

an outdoor unit having a compressor and a discharge pressure detector configured to detect a discharge pressure which is a pressure of refrigerant discharged from the compressor;

a plurality of indoor units each having an indoor heat exchanger, an indoor expansion valve and liquid side temperature detector configured to detect a heat exchange exit temperature which is a temperature of refrigerant flowing out from the indoor heat exchanger when the indoor heat exchanger is functioning as a condenser; and a controller configured to calculate an average refrigerant subcooling degree based on refrigerant subcooling degrees obtained from the plurality of indoor units, and execute a refrigerant amount balance control based on the average refrigerant subcooling degree, wherein the outdoor unit is installed to be positioned above the plurality of indoor units, and the plurality of indoor units comprises at least three indoor units having different installation heights therebetween, and wherein the controller is configured to execute the refrigerant amount balance control to adjust degrees of opening of the indoor expansion valves so that the refrigerant subcooling degrees of the indoor units become the average refrigerant subcooling degree obtained as a midpoint between a maximum value from among all of the obtained refrigerant subcooling degrees and a minimum value from among all of the obtained refrigerant subcooling degrees, or that the heat exchange exit temperatures of the indoor units become an average heat exchange exit temperature obtained as a midpoint between a maximum value from among all of the detected heat exchange exit temperatures and a minimum value from among all of the detected heat exchange exit temperatures, when the air conditioner performs heating operation.

2. An air conditioner comprising:

an outdoor unit having a compressor and a discharge pressure detector configured to detect a discharge pressure which is a pressure of refrigerant discharged from the compressor;

a plurality of indoor units each having an indoor heat exchanger, an indoor expansion valve and liquid side temperature detector configured to detect a heat exchange exit temperature which is a temperature of refrigerant flowing out from the indoor heat exchanger when the indoor heat exchanger is functioning as a condenser; and a controller configured to calculate an average refrigerant subcooling degree based on refrigerant subcooling degrees obtained from the plurality of indoor units, and execute a refrigerant amount balance control based on the average refrigerant subcooling degree, wherein the outdoor unit is installed to be positioned above the plurality of indoor units, and the plurality of indoor units comprises at least three indoor units having different installation heights therebetween, wherein the controller is configured to execute the refrigerant amount balance control to adjust degrees of opening of the indoor expansion valves so that the refrigerant subcooling degrees of the indoor units become the average refrigerant subcooling degree obtained as a midpoint between a maximum value from among all of the obtained refrigerant subcooling degrees and a minimum value from among all of the obtained refrigerant subcooling degrees, or that the heat exchange exit temperatures of the indoor units become an average heat exchange exit temperature obtained as a midpoint between a maximum value from among all of the detected heat exchange exit temperatures and a minimum value from among all of the detected heat exchange exit temperatures, when the air conditioner performs heating operation, and wherein the controller is further configured to determine whether there is an indoor unit where heating ability is not displayed among the plurality of indoor units or not, and execute the refrigerant amount balance control when there is an indoor unit where heating ability is not displayed.

3. The air conditioner according to claim 2, wherein the controller is further configured to determine whether there is an indoor unit where heating ability is not displayed among the plurality of indoor units or not by using the refrigerant subcooling degrees or the heat exchange exit temperatures.

4. The air conditioner according to claim 1, wherein the average refrigerant subcooling degree is obtained according to the following equation:

$$SC_v = SC_{max} + SC_{min}/2,$$

wherein $SC_v$ is the average refrigerant subcooling degree, $SC_{max}$ is the maximum value of the refrigerant subcooling degrees, and $SC_{min}$ is the minimum value of the refrigerant subcooling degrees, or wherein the average heat exchange exit temperature is obtained according to the following equation:

$$To_v = To_{max} + To_{min}/2,$$

wherein $To_v$ is the average heat exchange exit temperature, $To_{max}$ is the maximum value of the heat exchange exit temperatures and $To_{min}$ is the minimum value of the heat exchange exit temperatures.

5. The air conditioner according to claim 2, wherein the average refrigerant subcooling degree is obtained according to the following equation:

$$SC_v = SC_{max} + SC_{min}/2,$$

wherein $SC_v$ is the average refrigerant subcooling degree, $SC_{max}$ is the maximum value of the refrigerant subcooling degrees, and $SC_{min}$ is the minimum value of the refrigerant subcooling degrees, or wherein the average heat exchange exit temperature is obtained according to the following equation:

$$To_v = To_{max} + To_{min}/2,$$

wherein $To_v$ is the average heat exchange exit temperature, $To_{max}$ is the maximum value of the heat exchange exit temperatures and $To_{min}$ is the minimum value of the heat exchange exit temperatures.

6. An air conditioner comprising:

an outdoor unit having a compressor and a discharge pressure detector configured to detect a discharge pressure which is a pressure of refrigerant discharged from the compressor;

a plurality of indoor units each having an indoor heat exchanger, an indoor expansion valve and liquid side temperature detector configured to detect a heat exchange exit temperature which is a temperature of refrigerant flowing out from the indoor heat exchanger when the indoor heat exchanger is functioning as a condenser; and a controller configured to calculate an average refrigerant subcooling degree based on refrigerant subcooling degrees obtained from the plurality of indoor units, and execute a refrigerant amount balance control based on the average refrigerant subcooling degree, wherein the outdoor unit is installed to be positioned above the plurality of indoor units, and the plurality of indoor units comprises at least three indoor units having different installation heights therebetween, wherein the controller is configured to execute the refrigerant amount balance control to adjust degrees of opening of the indoor expansion valves so that the heat exchange exit temperatures of the indoor units become an average heat exchange exit temperature obtained as a midpoint between a maximum value from among all of the detected heat exchange exit temperatures and a minimum value from among all of the detected heat exchange exit temperatures, when the air conditioner performs heating operation, and wherein the controller is further configured to determine, by using the heat exchange exit temperatures, whether there is an indoor unit where heating ability is not displayed among the plurality of indoor units or not, and execute the refrigerant amount balance control when there is an indoor unit where heating ability is not displayed.

7. The air conditioner according to claim 6, wherein the average heat exchange exit temperature is obtained according to the following equation:

$$To_v = To_{max} + To_{min}/2,$$

wherein $To_v$ is the average heat exchange exit temperature, $To_{max}$ is the maximum value of the heat exchange exit temperatures and $To_{min}$ is the minimum value of the heat exchange exit temperatures.

* * * * *